US006354032B1

(12) United States Patent
Viani

(10) Patent No.: US 6,354,032 B1
(45) Date of Patent: Mar. 12, 2002

(54) TRIGGER STOP

(76) Inventor: Arthur Viani, 12219 SW. 131 Ave., Miami, FL (US) 33186

( * ) Notice: Subject to any disclaimer, the term of this patent is extended or adjusted under 35 U.S.C. 154(b) by 0 days.

(21) Appl. No.: 09/680,917

(22) Filed: Oct. 6, 2000

(51) Int. Cl.[7] ..... F41A 3/00

(52) U.S. Cl. ..... 42/69.03; 42/69.01; 42/42.03; 89/136; 89/147; 89/27.11

(58) Field of Search ..... 42/69.03, 69.01, 42/42.03, 42.01, DIG. 1; 89/136, 147, 27.11

(56) References Cited

U.S. PATENT DOCUMENTS 5,115,588 A * 5/1992 Bronsart et al. ..... 42/69.02
5,487,233 A * 1/1996 Jewell ..... 42/69.01
5,901,488 A * 5/1999 Oberlin ..... 42/84
5,924,231 A * 7/1999 Kidd ..... 42/69.03

* cited by examiner

*Primary Examiner*—J. Woodrow Eldred
(74) *Attorney, Agent, or Firm*—J. Sanchelima; A. Bordas

(57) ABSTRACT

A trigger stop connector for semi-automatic firearms that have an enclosed striker assembly. Incorporated into firearms without major structural changes, the trigger stop connector is designed to increase firing speed and prevent a fulcrum effect caused when a trigger mechanism travels a distance beyond the point of firing of the firearm, thus increasing target precision when discharging the firearm. The trigger stop connector, replacing a common connector, is designed with specific contact points to prevent overtravel of the trigger bar when operating in cooperation with the trigger of the firearm.

2 Claims, 2 Drawing Sheets

TRIGGER STOP

BACKGROUND OF THE INVENTION

1. Field of the Invention

The present invention relates to firearms, and more particularly, to a firearm trigger stop mechanism.

2. Description of the Related Art

Firearms are mostly utilized by law enforcement, sport enthusiasts, and private owners for target and game. While participating in sport or especially during moments of self defense, it is desirable to initially discharge the firearm with minimal trigger travel distance to allow for quick firing and rapid succession. In addition to rapid firing, precision shooting is an aim that is strived for. In most semi-automatic firearms that have an enclosed striker assembly, the trigger mechanism travels a distance beyond the point of firing, increasing the time period for the initial and successive discharges. Additionally, the excess distance beyond the point of firing of the firearm causes a fulcrum effect. This fulcrum effect causes the barrel of the firearm to generally travel in a downward and sideward path, depending if the user utilizes their right or left hand to discharge the firearm. This generally downward and sideward path of the barrel after the initial discharge of the firearm, caused by the user exerting force beyond the point of firing, results in a reduction of accuracy and precision when firing.

In the past, firearm users have introduced epoxy or similar compounds immediately behind the trigger area, to fill in and prevent the trigger from surpassing the point of firing. However, this remedy is not precise and generally leaves an unfinished appearance to the firearm.

There is a need for a practical and inexpensive assembly that can be incorporated into firearms without major structural changes to prevent a trigger from traveling any distance beyond the firing point to increase firing speed and target precision.

There are no similar trigger stop connector mechanisms to the best of applicant's knowledge, that are built-in in the firearms to prevent excess travel of a trigger beyond the point of firing.

SUMMARY OF THE INVENTION

It is one of the main objects of the present invention to provide a trigger stop connector for firearms that is utilized to prevent a trigger from traveling beyond the point of firing.

It is another object of the present invention to incorporate a trigger stop connector for firearms to prevent over manipulation of the trigger which causes a reduction of accuracy while repetitive firing.

It is yet another object of this invention to increase the speed of firing a firearm with a reduced trigger travel distance.

It is still another object of the present invention to provide a trigger stop connector mechanism utilized with semi-automatic pistols that have an enclosed striker assembly.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
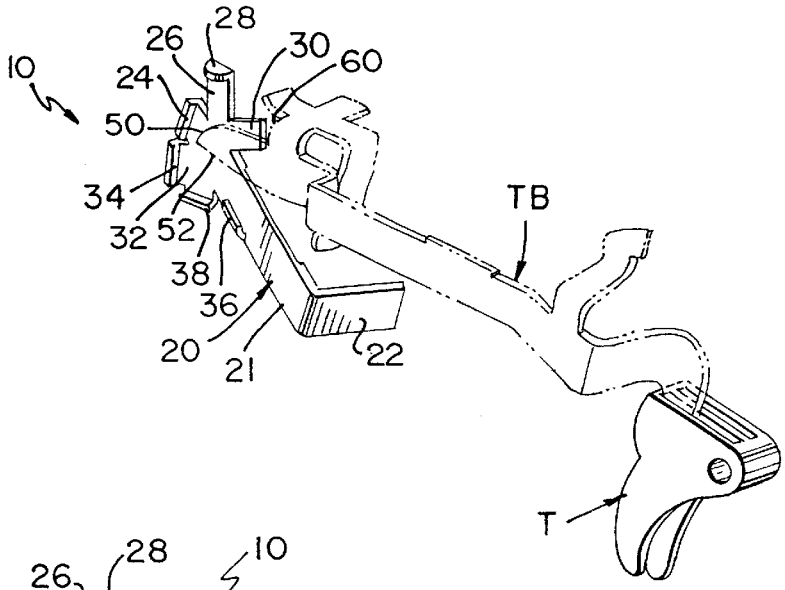
FIG. 1 represents an isometric view of the trigger stop connector with the trigger bar assembly shown in phantom.

Referring now to the drawings, where the present invention is generally referred to with numeral 10, it can be observed that it basically includes trigger stop connector 20, bent at predetermined locations to permit its mechanical transactions to effectuate a trigger stop connector mechanism. Trigger stop connector 20 is made out of a durable and light weight material as stainless steel, alloy metal, or other material having similar characteristics. In the preferred embodiment, trigger stop connector 20 is manufactured as a single metallic piece and has a general consistent thickness throughout of approximately 0.10 mm to 2.00 mm, so as to cooperatively interact with the general trigger mechanism of semiautomatic firearms that have an enclosed striker assembly. Such a firearm may be "GLOCK", without limitation to this specific brand.

Figure 3:
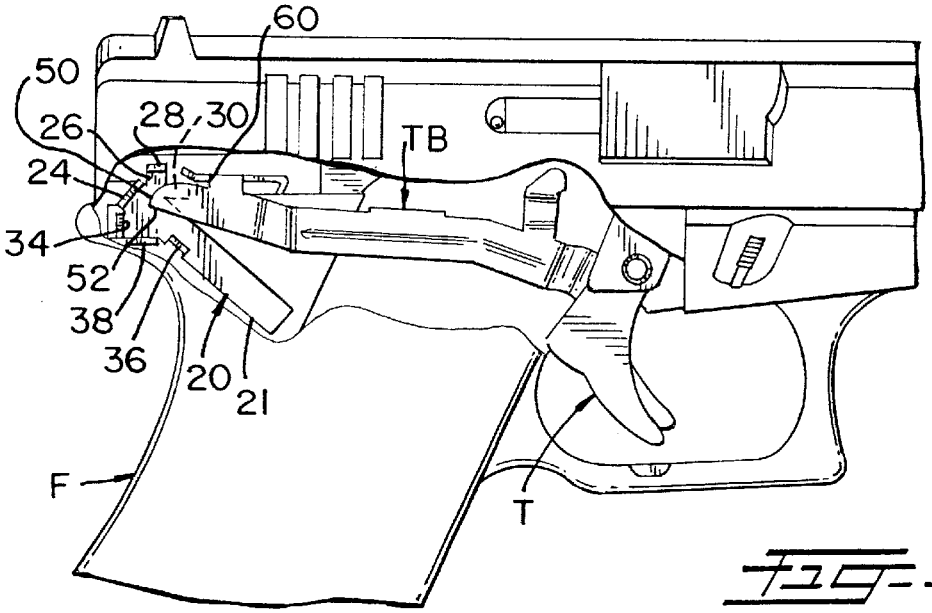
FIG. 3 illustrates an isometric view of a firearm in the cocked position.

As seen in FIG. 1, trigger stop connector 10 works in conjunction with trigger bar TB. While firearm F, shown in FIG. 3, is in the cocked position, trigger bar TB is biased against torso 21. As trigger T is pulled, trigger bar TB slidably travels in a generally rearward and downward direction. Connector lip 24 serves to guide curved end 50. Trigger bar TB remains biased against torso 21 at the point of firing. At the point of firing, certain points of contact are made to prevent further travel of trigger bar TB. Curved end 50 of trigger bar TB makes contact with stop lip 34, stop leg 30 makes contact with cross edge 60, and edge 52 of trigger bar TB simultaneously makes contact with stop lip 38 and stop lip 36 to prevent further travel of trigger T fixedly secured to trigger bar TB.

Upon attaining the point of firing, firearm F, seen in FIG. 3, cycles, whereas spring force, not shown, assists trigger bar TB to shift. Guided by connector lip 28 and no longer biased against torso 21, trigger bar TB slidably travels in a generally forward and upward direction until curved end 50 makes contact with connector lip 28, whereas trigger bar TB then reattains the cocked position, thus completing the firing cycle.

Figure 1A:
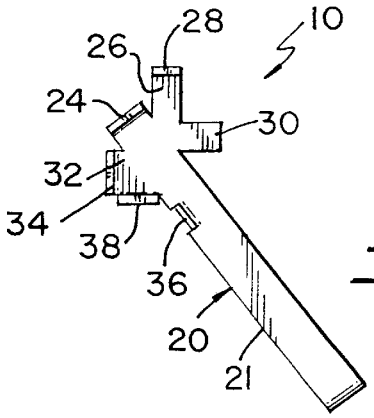
FIG. 1*a* shows a side view of the present invention.

Seen in FIG. 1*a* is present invention 10 in a preferred embodiment. The following dimensions of present invention 10 describe an example of the preferred embodiment. As seen, torso 21 has lip 24 extending a distance approximately between 0.25 mm to 2.00 mm. Lip 24 serves to contain trigger bar TB when biased against it. Connector leg 26 extends from torso 21 at a predetermined angle a distance approximately 1.00 to 3.00 mm and has connector lip 28 extending a distance of approximately 0.25 mm to 2.00 mm. Extending approximately 90 degrees from connector leg 26 is stop leg 30. Stop leg 30 extends approximately perpendicularly 1.00 mm to 5.00 mm from connector leg 26 and is approximately 1.00 to 3.00 mm in width. Opposite connector leg 26 and stop leg 30 is stop leg 32, which extends at a predetermined angle from torso 21 approximately 0.50 to 3.00 mm. Stop leg 32 has stop lip 34 extending approximately 0.25 to 2.00 mm. Extending from stop leg 32 is stop lip 38. Stop lip 38 extends approximately 0.25 to 2.00 mm from stop leg 32. Stop lip 36 is a lip cut and folded approximately 0.05 to 2.00 mm from torso 21. Stop lip 36 is approximately 1.00 to 2.00 mm in width.

Opposite in direction from connector lips 24; 28; and stop lips 34; 36; and 38 is connector leg 22, shown in FIG. 1. Connector leg 22 removably fits within firearm F, shown in FIG. 3, to secure instant invention 10.

Figure 2A:
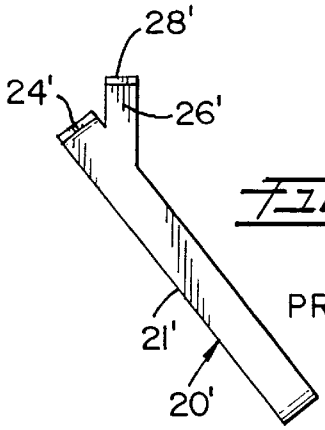
Fig. 2a. PRIOR ART
FIG. 2*a* shows a side view of the prior art connector.
Figure 2:
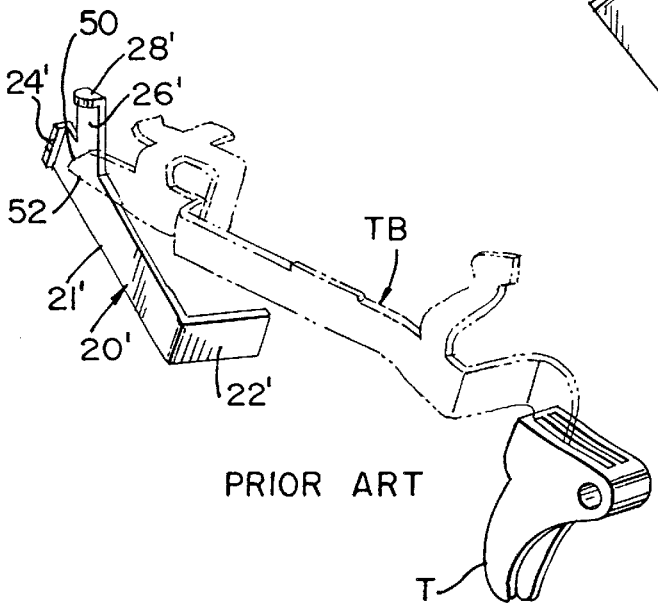
PRIOR ART Fig. 2.
FIG. 2 represents an isometric view of the prior art connector with the trigger bar assembly shown in phantom.

Seen in FIG. 2 is prior art connector 20'. Prior art connector 20' works in conjunction with trigger bar TB. While firearm F, shown in FIG. 3, is in the cocked position, trigger bar TB is biased against torso 21'. As trigger T is pulled, trigger bar TB slidably travels in a generally rearward and downward direction. Connector lip 24' serves to guide curved end 50. Trigger bar TB remains biased against torso 21' at the point of firing. After the point of firing, trigger bar TB continuous to travel generally in a rearward and downward direction until a spring force, not shown, causes trigger bar TB to shift. Guided by connector lip 28', edge 52 of trigger bar TB slidably travels in a generally forward and upward direction until completing the firing cycle.

Shown in FIG. 2*a* is prior art connector 20'. Torso 21' has lip 24'. Lip 24' serves to contain trigger bar TB when biased against it. Connector leg 26' extends from torso 21' at a predetermined angle and has connector lip 28'. Opposite in direction from connector lips 24' and 28' is connector leg 22', shown in FIG. 2. Connector leg 22' removably fits within firearm F to remain secured.

As best seen in FIG. 3, firearm F is in the cocked mode. Once the user grasps firearm F, aims, and is ready to fire, the user exerts a force to overcome the force of trigger T. Trigger T is mechanically connected to trigger bar TB. Upon depressing trigger T, trigger bar TB is guided and thereby moves in a generally rearward and downward path. Stop leg 30 and stop lips 34; 36; and 38 are designed as specific contacts to prevent overtravel of trigger bar TB when operating in cooperation with trigger T of firearm F.

Figure 4:
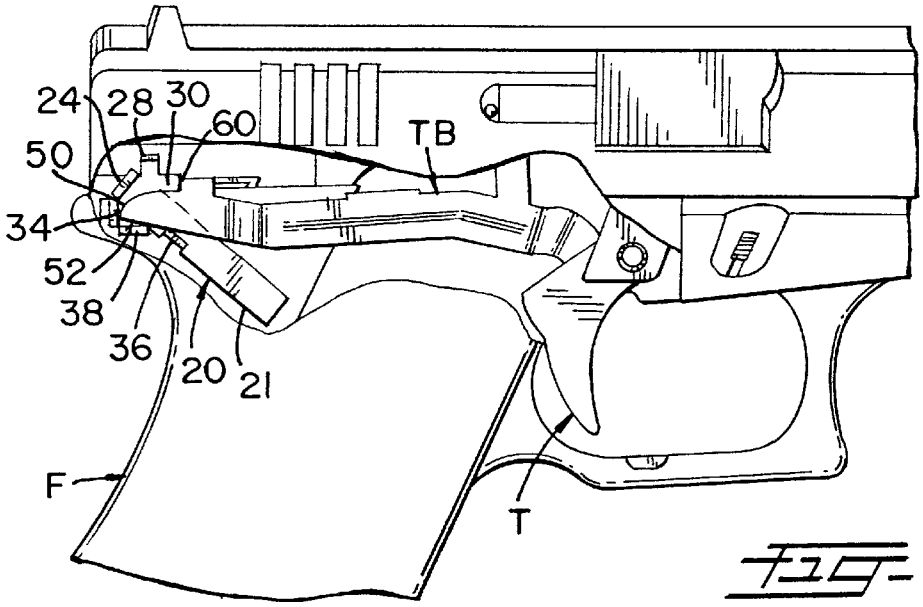
FIG. 4 illustrates an isometric view of a firearm in the fired position.

As best seen in FIG. 4, firearm F is in the fired mode. At this moment, the user has pulled trigger T with sufficient force and a sufficient distance to activate the firing pin mechanism, not shown, which in turn makes contact with the primer of a bullet, not shown, discharging firearm F. At the moment of discharge, stop leg 30 contacts cross edge 60, curved end 50 of trigger bar TB makes contact with stop lip 34, and edge 52 makes contact with stop lip 36 and stop lip 38. These contact points prevent over manipulation of trigger T past the point of firing. Thus, the ability to prevent movement of firearm F is increased because the fulcrum effect is greatly reduced. The excess distance beyond the point of firing of firearm F is what causes the fulcrum effect. The fulcrum effect causes the barrel of firearm F to generally travel in a downward and sideward path. Additionally, these contact points establish a shortened trigger travel distance. With a shortened trigger travel distance, less time is required for the user to discharge firearm F. As a result, the user benefits from each subsequent discharge with less time required for firearm F to cycle back into the cocked mode, as in FIG. 3.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A trigger stop connector for firearms having an enclosed striker assembly, comprising:

A) an elongated member having first and second ends, said elongated member having a first bent lip extending perpendicularly from said first end and a second bent lip extending perpendicularly from said elongated member at a first predetermined distance from said first end towards said second end without reaching said second end, said elongated member having a first leg perpendicularly extending a second predetermined distance from said second end, said elongated member further having second, third, and fourth legs extending therefrom, whereas said second leg has a third bent lip extending perpendicularly from said second leg, said third leg includes fourth and fifth bent lips perpendicularly extending from said third leg; and B) means for increase firing speed of said firearm by restricting excessive movement of a trigger bar mechanism, said trigger bar mechanism having a trigger member, wherein said means includes minimizing travel of said trigger member by guiding said trigger bar mechanism upon said elongated member with first and second bent lips of said elongated member and said first, second, third, fourth legs, and their respective bent lips, of said elongated member.

2. The trigger stop connector for firearms having an enclosed striker assembly set forth in claim 1, having means to prevent over manipulation of said trigger member thereby increasing the accuracy and precision of said firearm while repetitive firing when a user continues to pull said trigger after said firearm has discharged, wherein said means includes restricting the movement of said trigger bar mechanism with first and second bent lips of said elongated member and said first, second, third, fourth legs, and their respective bent lips, of said elongated member.

* * * * *